United States Patent [19]

Goold et al.

[11] Patent Number: 4,774,903

[45] Date of Patent: Oct. 4, 1988

[54] MOORING TETHER

[75] Inventors: Graham E. Goold, Ryde; Michael D. Cooper, Adgestone, both of England

[73] Assignee: The Marconi Company Limited, England

[21] Appl. No.: 4,656

[22] Filed: Jan. 20, 1987

[30] Foreign Application Priority Data

Feb. 12, 1986 [GB] United Kingdom ..... 8603473

[51] Int. Cl.[4] ..... B63B 21/00

[52] U.S. Cl. ..... 114/230; 114/293

[58] Field of Search ..... 114/230, 293, 294, 264; 405/203, 224, 250; 166/354, 352, 355; 57/204, 6, 3; 87/6; 267/154, 73, 69

[56] References Cited

U.S. PATENT DOCUMENTS

| | | | |
|---|---|---|---|
| 2,374,249 | 4/1945 | Wadsworth, Jr. | 244/3 |
| 2,908,141 | 10/1959 | Marsh, Jr. | 114/294 |
| 3,177,684 | 4/1965 | Bossler, Jr. | 267/154 |
| 3,333,788 | 8/1967 | Dryden | 102/378 |
| 4,635,884 | 1/1987 | Nöhren | 244/142 |

FOREIGN PATENT DOCUMENTS

| | | |
|---|---|---|
| 866611 | 4/1961 | United Kingdom . |
| 989981 | 4/1965 | United Kingdom . |
| 1103991 | 2/1968 | United Kingdom . |
| 1106821 | 3/1968 | United Kingdom . |
| 1199153 | 7/1970 | United Kingdom . |
| 1293668 | 10/1972 | United Kingdom . |
| 1459932 | 12/1977 | United Kingdom . |

*Primary Examiner*—Sherman D. Basinger
*Assistant Examiner*—Edwin L. Swinehart
*Attorney, Agent, or Firm*—Kirschstein, Kirschstein, Ottinger & Israel

[57] ABSTRACT

Several cables extend between a buoyant body to be moored and the sinker on the sea bed. Intermediate spacing members hold the cables apart from one another to maintain the configuration. At zero rotation when the tether formation itself is in equilibrium half the number of cables exert a clockwise torque and half exert an equal and opposite anticlockwise torque. Any small rotation of the moored body causes the tension to increase in the cables opposing such rotation and to decrease in the other cables, so the body is restored to the equilibrium position. The tether thus exhibits high torsional stability. Cables can be configured to enable the tether to tilt relative to the buoyant body or sinker whilst still retaining high torsional stability.

14 Claims, 5 Drawing Sheets

MOORING TETHER

BACKGROUND OF THE INVENTION

1. Field of the Invention

This invention relates to a tether intended primarily but not exclusively, for underwater moorings where rotational stability is important.

2. Descripton of Related Art

Known mooring schemes affording some degree of rotational stability include crossed mooring cables used on very large off shore structures, and a paddle deployed beneath the moored body which reduces motion in all planes. Neither of these systems can be stowed very compactly, or is suitable for mooring objects with a small baseline. Cables mooring small bodies tend to 'wind-up', which reduces the torque available and hence reduces torsional stability.

SUMMARY OF THE INVENTION

An object of the invention is to provide a tether which provides substantial torsional rigidity.

According to one aspect of the invention a tether comprises first and second members and first and second pluralities of tension elements connected between the members, the first and second pluralities of tension elements tending to rotate the members in first and second opposite directions respectively about an axis extending through both members when a separating force is applied between the members for providing torsional stability about said axis of one member relative to the other.

The tether may comprise connection points for the tension elements which, for each of the pluralities of tension elements or for all the tension elements, are regularly disposed about and equidistant from said axis on each of the members. Each tension element may be attached to a respective one of the connection points, or a respective cable of each of the pluralities may be attached to a respective connection point.

Each tension element may have corresponding connection points to which it is connected on the first and second members, and which are relatively displaced around said axis by a displacement angle common to all the tension elements. The number of cables may be four, and the tether arranged to maintain torsional stability about the axis for a range of relative attitudes of the members.

The members may be rods bearing connection points near their ends, or rings lying in a plane perpendicular to the axis when the tether is deployed. The displacement angle can be chosen in relation to the distance of the connection points from the axis and to the axial spacing of the first and second members to provide a maximum restoring torque at a predetermined angle of relative rotation of the members, which angle may be 0°.

According to another aspect of the invention a tether comprises a plurality of members, adjacent ones of the members being connected by first and second pluralities of tension elements, said first and second pluralities of tension elements tending to rotate the members in first and second opposite directions respectively about an axis extending through the members when a force tending to separate the members is applied, for providing torsional stability of the members relative to each other.

The tension elements may be continuous between all of said members. The number of cables in the respective first and second pluralities of cables between an outermost one of the members and the adjacent member is preferably two, the outermost member bearing two connection points 180° apart, a respective cable of each plurality being connected to a respective connection point, the tether thereby maintaining torsional stability about said axis for a range of relative attitudes of said members.

One of the members may be a buoyant body arranged to be tethered to a heavy base. The tension elements may be cables.

According to another aspect of the invention a method for providing torsional stability of a first member relative to a second member wherein first and second pluralities of tension elements are connected between the members, the first and second pluralities of tension elements tending to rotate the members in first and second opposite directions respectively about an axis extending through both members when a separating force is applied between the members. The second member may be a base and the first member a body to be tethered to said base.

BRIEF DESCRIPTION OF THE DRAWINGS

One embodiment of the invention will now be described, by way of example, with reference to the accompanying drawings of which.

DETAILED DESCRIPTION OF THE PREFERRED EMBODIMENTS

Figure 1:
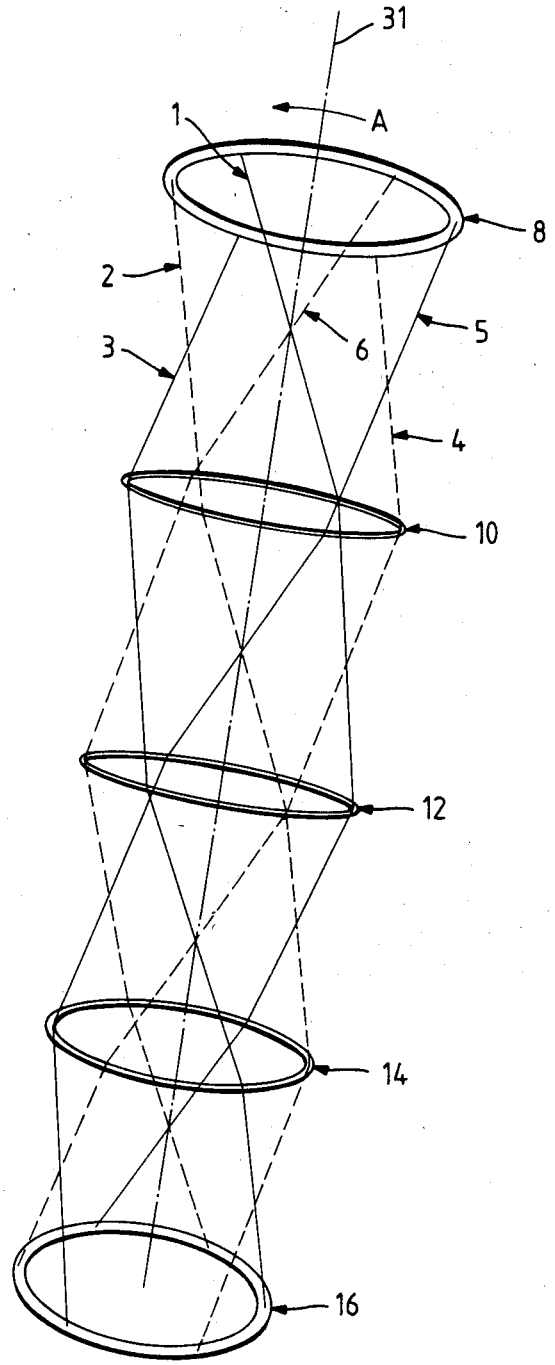
FIG. 1 shows a mooring tether in accordance with the invention, in the deployed condition.

Referring to FIG. 1, the tether comprises five rigid spacing rings 8,10,12,14,16 connected together by two sets of cables 1,3,5 and 2,4,6 each cable being continuous from the highest ring 8 to the lowest ring 16. One of these sets, cables 1,3,5, is wound in anti-clockwise helix; the other set, cables 2,4,6, is wound in a clockwise helix. In this description the terms clockwise and anticlockwise are used as though viewing the tether from above, looking down. The opposite hand of the helices provides torsional stability of the tether when the top and bottom rings 8 and 16 are subject to a separating force. In the case of a body to be moored underwater, the bottom ring 16 is connected to a base or sinker (not shown), and the top ring 8 is attached to the body to be moored, and the separating force between the two rings is the buoyant force on the body. In this figure, only the tether itself is shown, with the base, body and means for attaching the tether omitted for clarity. The top and bottom rings 8 and 16 could be omitted and the cables attached directly to connection points on the body and the base. The 'base' could be simply the seabed itself, the cables being attached to pegs driven into the earth. It will be understood that the tether could equally well be used 'inverted' to support a sinking body, with the 'base' then being above the body as, say, a floating platform.

The separating force produces a tension in each cable, one component of which acts to rotate the rings anticlockwise (cables 1,3,5) or clockwise (cables 2,4,6). These rotational forces are symmetrical about the axis 31 perpendicular to the plane of the rings so that, under zero applied rotational force, the clockwise torque balances the anticlockwise torque. When a rotational force is applied, for example, by the moored body twisting in a current, the top ring 8 rotates relative to the fixed bottom ring 16, and the tension increases in one set of cables. Thus, if the body rotates in the direction A indicated by the arrow, i.e. clockwise, the tension increases in cables 1,3 and 5, which are wound anticlockwise, thereby pulling the rings 8,10,12,14 towards the ring 16 on the sinker. The separation between the rings is reduced, so the other set of cables becomes slack. The torque exerted on the body is now entirely due to cables 1, 3 and 5 and acts to oppose the applied rotation, and restore the body to a position of no net torque. Thus, a small angular displacement in either direction results in full restoring torque becoming available, so the assembly exhibits high torsional stability about its longitudinal axis 31. For effective operation the cables should be of a kind which have high tensile stiffness, e.g. bowden cable. It will be appreciated however that tension elements other than cables could be used, e.g. chains. Discontinuous cables, i.e. short cable sections between adjacent rings, could also be used.

Figure 2:
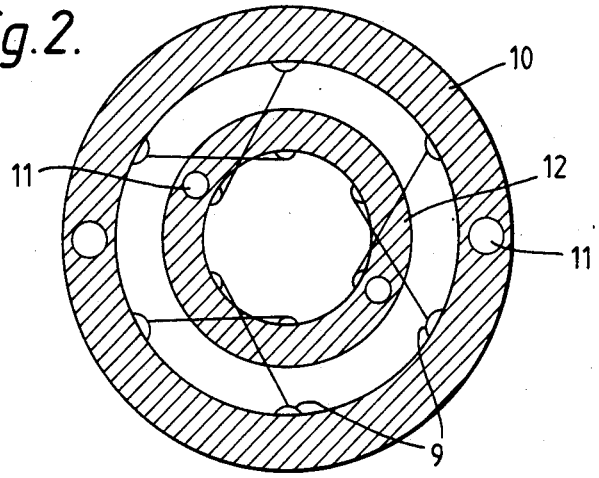
FIG. 2 is a plan view of two adjacent rings of the tether.

FIG. 2 shows a plan view of two successive rings, 10, 12 of the tether of FIG. 1 with the upper ring 10 expanded to show the pattern of cable attachments. Each ring bears six cable attachments 9 equally spaced around the inside edge of the ring, and has two spigot holes 11 opposite each other for engagement with spigots (projecting from the base, say) in the stowed position. The cable attachments 9 may take a variety of forms. They could, for example, be clamps, attaching each cable fixedly at each ring. The spigot holes 11 are indexed round on successive rings so that the cable attachments are moved out of alignment to avoid interference when the tether is stowed, since the cable attachments 9 may protrude above or below the rings. The number of cable attachments is not necessarily as large as the number of cables. One cable from each set may be attached at some or all of the connection points, as in the embodiment shown in FIG. 5, for example.

Figure 3:
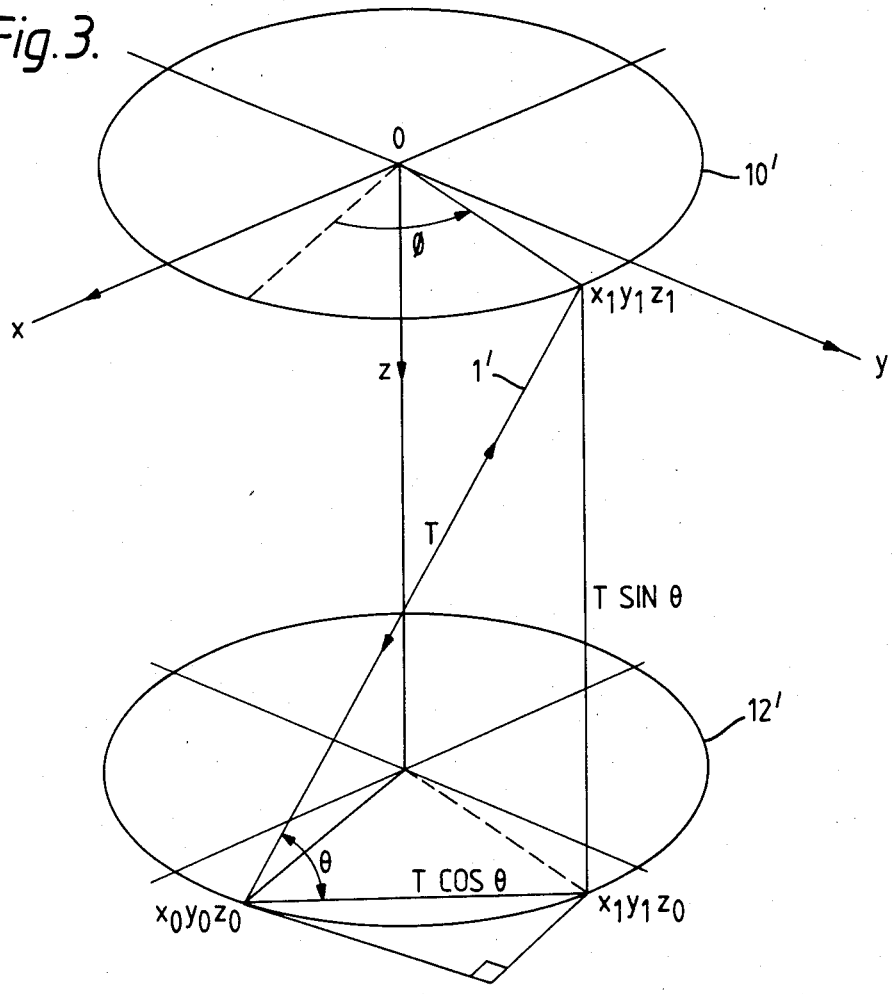
FIG. 3 shows a single cable extending between two rings.

Referring now to FIG. 3 which shows a single cable 1' between two adjacent rings 10', 12' it can be shown that $$Q = \frac{(W - B)\, r^2 \sin(\phi + d\phi)}{z_1 - z_o}$$

where r is the radius of the rings $\phi$ is the offset angle of the cable between the rings W is the weight of the body B is the buoyant force $d\phi$ is the angle of rotation beyond the offset angle and Q is therefore a maximum when $\phi + d\phi = 90°$.

Figure 4:
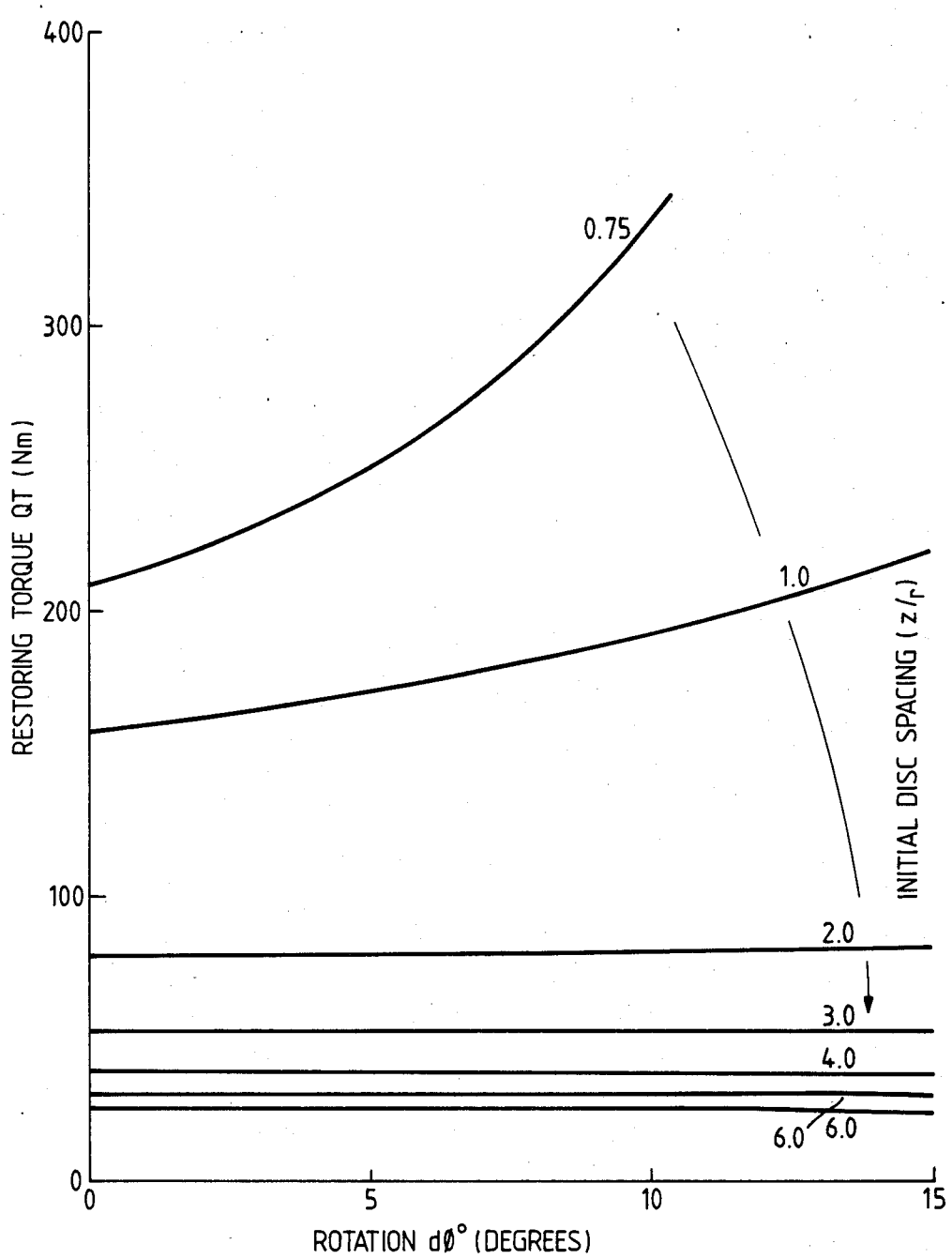
FIG. 4 is a plot of restoring torque against relative rotation of the rings.

FIG. 4 is a plot of restoring torque against relative rotation of adjacent rings for a selection of initial ring spacings (z/r) with:

ring radius r=0.2667 meters net buoyancy W-B=60 g Newtons initial offset angle $\phi = 90°$.

The plot clearly shows how the torque is lower at large ring spacing. It is therefore advantageous to have the spacing at no greater than about twice the ring radii. Also, adjacent cables are less likely to twist together when the separation between the rings is small. At larger separations an initial offset angle of 90° gives decreasing torque beyond a certain relative rotation of the rings, so smaller initial offset angles are preferred so as to give steadily increasing torque from the stable condition. It may, for example, be preferable to have maximum restoring torque exerted at say 5° or 10° of rotation rather than 0°. The ratio z/r and the offset angle $\phi$ are chosen for a particular tether by taking into account these theoretical considerations for maximum torque at a certain angle and practical considerations as to how heavy or bulky the tether can be and the degree of hydrodynamic torque expected to be exerted on the body.

Many variations are possible in the cable configuration, provided always that when no rotational force is applied the net torque on the rings is zero. The tether of FIG. 1 uses six cables with an initial offset angle of 60° although there is no essential relation between the offset angle and the number of cables and the invention includes within its scope other numbers of cables (at least two in each set), different, possibly irregular, dispositions about the rings and offset angles for a given cable which differ at successive rings. Larger numbers of cables afford more stability against pitching motion of the rings. The operation of the tether is complex when all factors are taken into consideration, such as steady currents inclining the tether, or oscillation, and the configuration of the cable will be chosen to give the best performance in the particular conditions.

Figure 5:
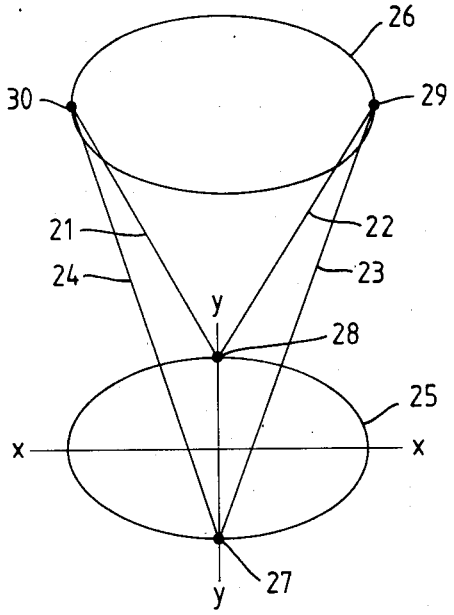
FIGS. 5 and **5*a*** show a "universal joint" cable configuration.
Figure 5A:
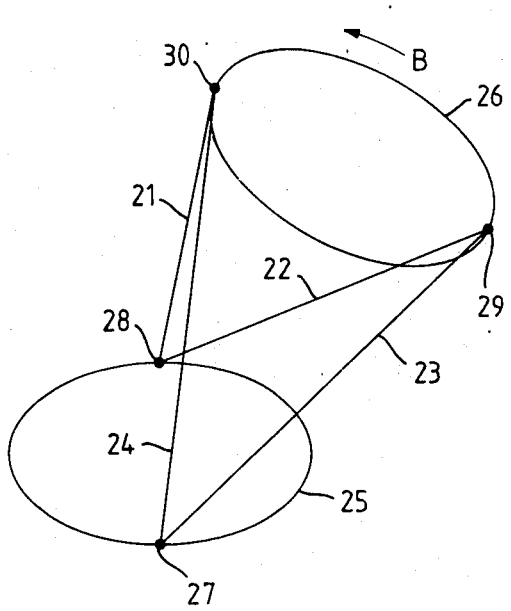
Figure 6:
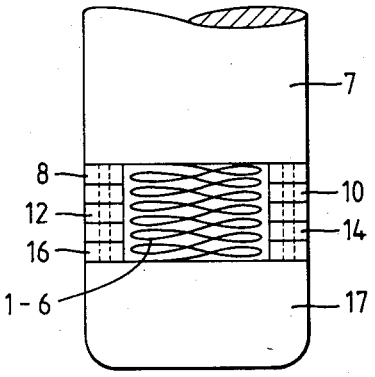
FIG. 6 shows the tether stowed.

FIG. 5 shows a configuration of four cables 21–24 between two rings 25,26 which acts as a universal joint allowing the tethered body to tilt in the direction of current flow and in the plane normal to that flow whilst retaining torsional stiffness. Such a joint can be used just at the top and/or bottom of the tether, or the entire tether could be composed of such joints as shown in FIG. 6. Another advantage of this configuration is that it is much less likely to suffer from interference between cables.

For current flow parallel to the line X—X with the ring 25 assumed fixed, i.e. rigidly attached to the base, the four cables and the ring 26 will tilt (as indicated in FIG. 4*a*) so that the two rings no longer lie in parallel planes. The offset angles increase between corresponding connection points 27,29 and 28,29 (for tilt to the right) and decrease between corresponding connection points 27,30 and 28,30. Rotation of the upper ring 26 in the direction B (anticlockwise) causes alternate cables 22,24 to go slack whilst cables 21,23 exert a restoring torque, or vice versa for clockwise rotation.

If current flow is parallel to the line Y—Y the ring alone tilts (about the line through connection points 29,30). The cable angles and their operation on rotation are unaffected. Clearly, for current flow having components in both directions the behaviour of the tether will be a combination of the two behaviours described above—the whole tether will tilt and the ring will also rotate about the line through its connection points.

The rings shown in FIGS. 1, 2, 3, 5 and 5*a* are one example of a suitable member for cable separation and support. Rings, as opposed to discs, enable the cable to be stowed inside the rings prior to deployment, providing compact stowage. FIG. 6 shows the tether of FIG. 1 stowed. The rings are stacked onto a spigot 13 and the cables occupy the space within the stack of rings. Attached to the bottom ring 16 is a sinker 17 for the assembly which is of sufficient mass to resist dragging motion on the seabed. The top ring 8 is attached to the body 7 to be moored. Another advantage of rings is that they experience lower hydrodynamic drag then discs, say, or other solid members.

Figure 7:
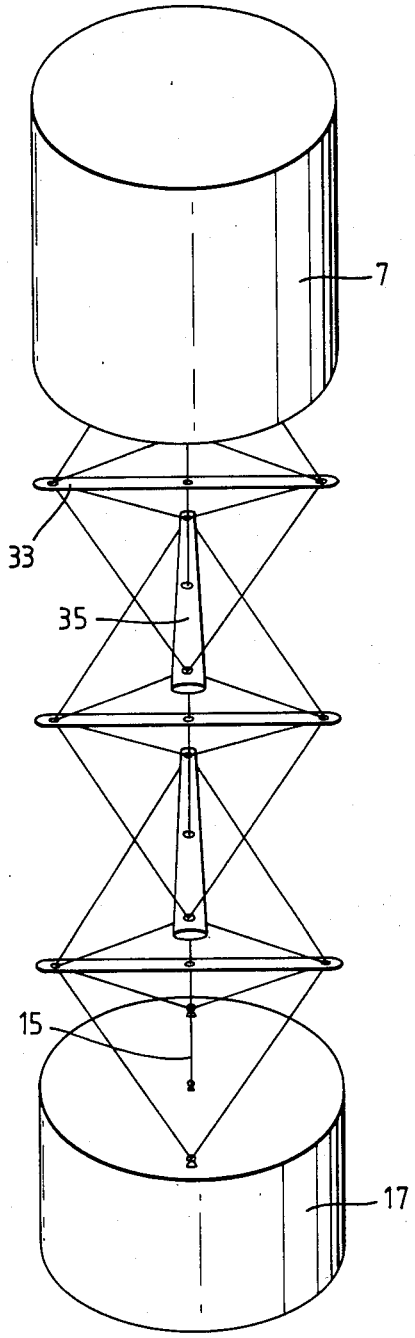
FIG. 7 shows a complete 4-cable tether.

FIG. 7 shows an embodiment of the tether using rods 33 as spacing members with each rod perpendicular to its neighbour or neighbours. The four cables (two in each set) are configured as "universal joints" as in FIG. 5 with offset angles of 90°. Rods reduce the volume and mass of the tether which may be important for stowage or deployment. A central tether cable 15 is included as a fail safe feature should any of the other cables break. The rods are preferably oval in cross-section to reduce hydrodynamic drag, once deployed, in the direction of the water current yet to provide more drag when the tether is being deployed, so as to show the decent to the sea-bed. The top and bottom connections are made directly to the body and base respectively.

Figure 8:
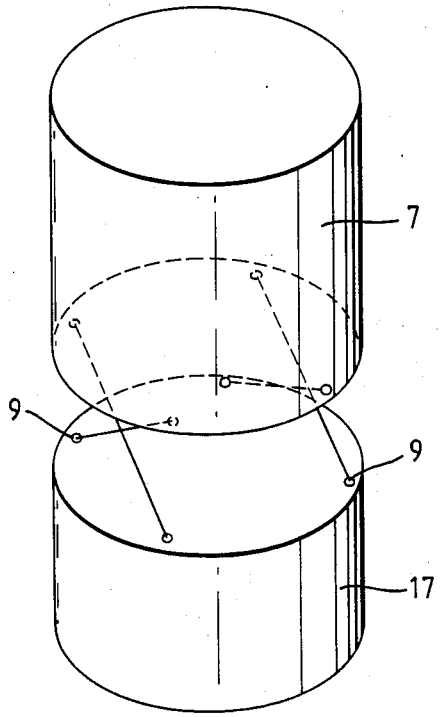
FIG. 8 shows a short tether arrangement.

The simplest embodiment of the tether in accordance with the invention uses no spacing members. The cables are attached directly to the body and the base, as shown in FIG. 8. This arrangement is only suitable for a short tether, that is for one having a small value of z/r since a very long cable would necessitate very small, and hence ineffective, offset angles. Again the universal joint cable configuration may be used, or any other configuration.

Whilst the embodiments described relate to underwater mooring, the invention could also be used to tether to the ground an object which floats in air, or to tether a heavy object to some raised platform. It is also suitable for use in outer space in which case the separating force would not be gravity/buoyancy but could be provided for example by mechanical means or by tethering the body to an accelerating base.

We claim:

1. A tether comprising: at least four members lying in use along an axis extending through said members, first and second pluralities of tension elements connecting neighboring said members, said first and second pluralities of tension elements tending to rotate said members in first and second opposite directions respectively about said axis when a force tending to separate said members is applied, thus providing torsional stability of each of said members relative to the other said members, each one of said members being connected to said tension elements at positions on each one of said members such as to maintain said tension elements spaced around and radially from said axis.

2. A tether according to claim 1 having connection points for said tension elements which, for each of said pluralities of tension elements, are regularly disposed about and equidistant from said axis on each of said members.

3. A tether according to claim 2 having connection points for said tension elements which are regularly disposed about and equidistant from said axis on each of said members.

4. A tether according to claim 3 wherein at least one of said members is a ring lying in a plane perpendicular to said axis when said tether is deployed.

5. A tether according to claim 3 wherein each of said tension elements is attached to a respective one of said connection points.

6. A tether according to claim 2 wherein each tension element has corresponding connection points to which it is connected on said members, said corresponding connection points being relatively displaced around said axis by a displacement angle common to all of said tension elements.

7. A tether according to claim 6 wherein said tension elements are cables.

8. A tether according to claim 7 wherein said displacement angle is equal to $360°/_n$ where n is the total number of cables.

9. A tether according to claim 7 wherein the number of cables in the respective first and second pluralities of cables between an endmost one of said members and the neighboring one of said members is two and wherein said endmost one of said members bears two connection points 180° apart, a respective cable of each of said pluralities being connected to a respective one of said connection points, every cable thereby remaining in tension and the tether thus maintaining torsional stability about said axis for different relative attitudes of said members.

10. A tether according to claim 9 wherein said members are rods bearing said connection points near their ends.

11. A tether according to claim 6 wherein said displacement angle is chosen in relation to the distance of said connection points from said axis and to the axial spacing of said members to provide a maximum restoring torque at a predetermined angle of relative rotation of said members.

12. A tether according to claim 11 wherein said predetermined angle is 0°.

13. A tether according to claim 1 wherein said tension elements are continuous between all of said members.

14. A tether according to claim 7 wherein one endmost member is a buoyant body and the other endmost member is a heavy base.

* * * * *